United States Patent [19]

Estberg

[11] 4,407,076

[45] Oct. 4, 1983

[54] PROCESS FOR TREATING WOOD

[75] Inventor: Magnus F. O. Estberg, Rimbo, Sweden

[73] Assignee: Kenogard AB, Stockholm, Sweden

[21] Appl. No.: 311,409

[22] Filed: Oct. 14, 1981

[30] Foreign Application Priority Data

Oct. 17, 1980 [SE] Sweden ..... 8007297

[51] Int. Cl.[3] ..... F26B 3/00; F26B 7/00; F26B 5/04

[52] U.S. Cl. ..... 34/9.5; 34/13.8; 34/16.5

[58] Field of Search ..... 34/9.5, 16.5, 13.4, 34/13.8

[56] References Cited

U.S. PATENT DOCUMENTS 2,535,925 12/1950 Hudson ..... 34/16.5
2,860,070 11/1958 McDonald ..... 34/16.5

FOREIGN PATENT DOCUMENTS

76/14934 12/1976 France .
136057 4/1977 Norway .
301870 6/1968 Sweden .
401994 6/1978 Sweden .
1181246 2/1970 United Kingdom .
1227180 4/1971 United Kingdom .
1402191 8/1975 United Kingdom .
670434 6/1979 U.S.S.R. .

*Primary Examiner*—John J. Camby
*Attorney, Agent, or Firm*—Fred Philpitt

[57] ABSTRACT

Impregnated wood and other impregnated cellulose based materials are dried in high boiling drying media, drying oil, under reduced pressure. During the treatment the material is withdrawn from direct contact with the drying medium at several times. The absorption of oil in the materials can hereby be controlled. Materials of different qualities and origin can be dried with good results and the oil absorption does not have to be made dependent on the penetration depth of the impregnating solution. An autoclave for drying of wood according to this process preferably has a rectangular inner cross section and is provided with means for lifting and lowering the materials. Preferably a lifting table or frame.

10 Claims, 3 Drawing Figures

PROCESS FOR TREATING WOOD

Figure 1:
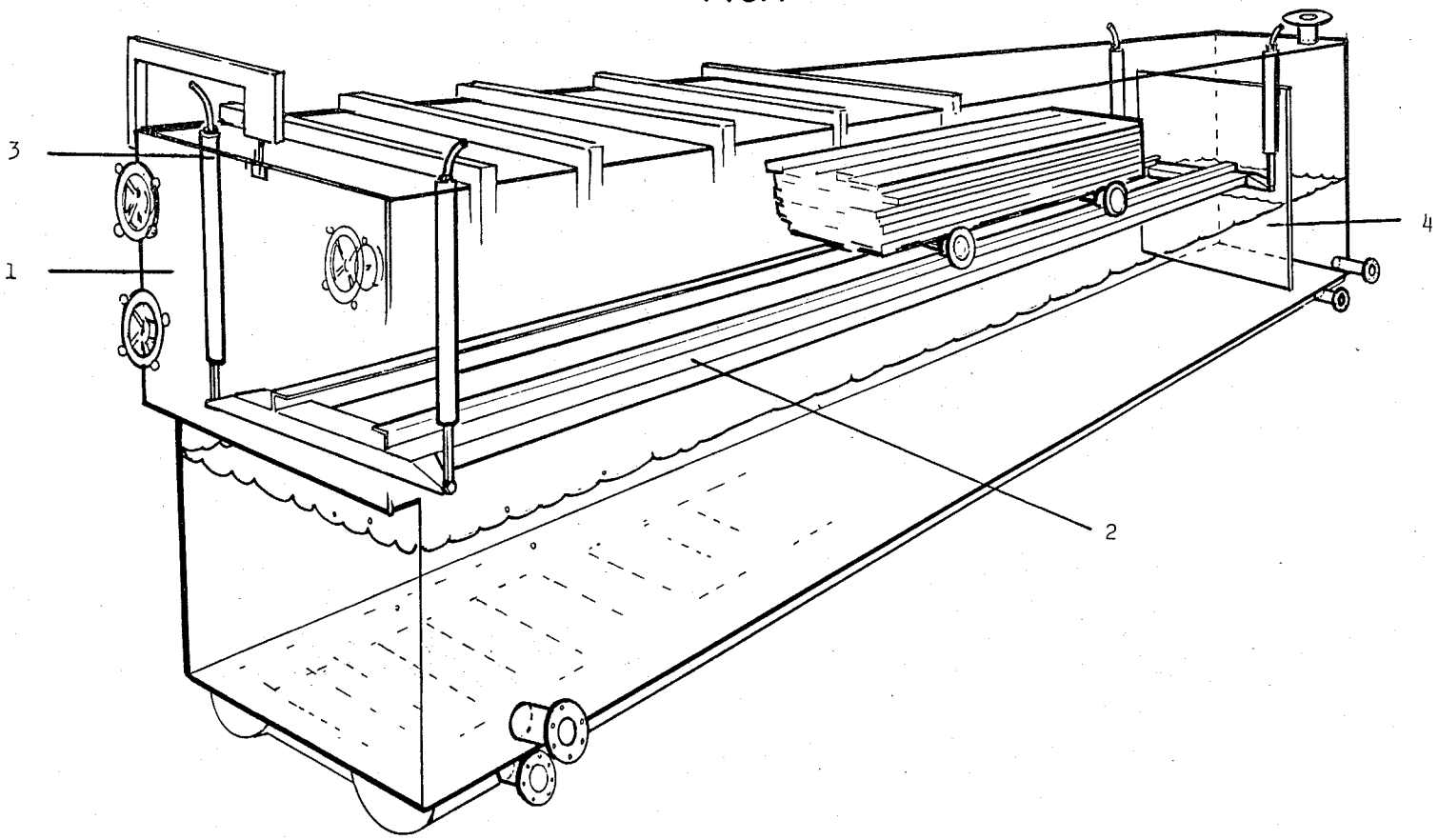

The present invention relates to a process for drying impregnated wood and other impregnated cellulose based materials. More particularly the invention relates to a process for controlling the absorption of drying medium in the materials and for preventing excess retention when drying in high-boiling liquid media at reduced pressures. The invention also relates to a container, suitable for drying.

It is well-known to dry wood and other organic materials, which have been impregnated with various preservative agents, by treating the materials in high boiling oils and similar fluids under vacuum. A process of this kind is described in the U.S. Pat. No. 3,560,251. This process is used commercially for drying wood, but it is disadvantageous in that it does not permit control of the retention of oil in the wood and in practice it only gives an acceptable oil retention for particularly suitable wood.

A certain amount of oil in the surface layer of the treated wood is desirable as the oil has a positive effect on the water repellant properties of the wood and on its dimension stability. It is thus essential that the retention can be controlled and regulated in order that the drying method can be applied to wood of varying origin and quality and it is essential that excess uptake can be prevented as oil otherwise will be released from the wood a long time after the treatment and the wood thus will be completely unsuitable for certain purposes. Previous attempts to modify the oil retention by regulating the penetration depth for the impregnating solution in the impregnating step which preceds the drying have resulted in an inferior impregnation or in a too high amount of absorbed oil.

It has now been found that it is possible to modify the retention of drying medium in impregnated wood and other impregnated materials, when treating these in a drying medium consisting of a high boiling liquid, by withdrawing the materials from contact with the drying medium at several times. If the drying medium and the material that is treated are separated quickly and repeatedly during the drying process the uptake in the materials can be modified to such a degree that materials of varying origin and quality can be dried with satisfactory results, excess retention can be prevented and the retention does not have to be made dependent on the penetration depth of the impregnating solution.

It might seem surprising that the wood does not crack or warp during the phase of the drying when it is not in contact with the drying medium. It has, however, been found that drawbacks of this kind can be completely avoided by selecting a suitable vacuum during this phase, i.e. by properly adjusting the drying rate.

The present invention is advantageous in that recirculation of the drying medium by pumping, which usually is required to get a homogenous heat distribution, can be avoided, partly or completely, as the separation of the treated material and the drying medium gives a satisfacotry stirring of the latter. Another advantage is that the foaming which normally occurs when drying in oil can be controlled.

The rpesent invention thus relates to a method of drying impregnated wood and other impregnated cellulose based materials by treatment in high boiling, liquid media under reduced pressure whereby the materials at several times during the treatment are withdrawn from direct contact with the liquid medium.

The invention will be discussed with reference to wood in the following. However, what is said is of course also applicable to other cellulose based materials and products, such as finished joineries, fibre boards etc.

The materials which are dried according to the present process are impregnated, i.e. treated with solutions of preservative agents. The method of preservation method used is of minor importance, usually an empty-cell process such as the Lowry- or the Rueping process is used to keep the retention of solvent fairly low and to facilitate the subsequent drying. The impregnating solution can be based either on water or solvents.

As mentioned previously, it is well-known to dry impregnated materials under reduced pressure in liquid, high boiling media. These media will hereinafter be referred to as drying media and they generally consist of some kind of oil. The drying medium shall be high boiling, i.e. the boiling point of the medium should be clearly separated from the boiling point of the water or the solvent of the impregnating solution at the vacuum used at the drying. At drying, the drying temperature, i.e. the temperature of the drying medium, should be kept approximately within the range 60° to 110° C., and the temperature should normally not exceed 90° C. as higher temperatures increase the risk of damaging the wood. The drying medium should generally have a boiling point above 250° C. and preferably about 300° C., and the medium is selected in a known manner with respect to the impregnating solution that has been used, and care is taken in order that the drying medium will not be decomposed or discoloured by the preservative agent in the impregnating solution and that the drying medium has a suitable boiling point relative to the solvent or the water in the impregnating solution. As examples of suitable drying media can be mentioned drying oils such as linseed oil, tall oil, soy bean oil, colza oil, non-drying oils such as mineral oils etc. and mixtures of such oils. A pigment is often incorporated in the drying medium so that the treated material will be pigmented.

The drying process is carried out under reduced pressure and generally at a vacuum above 75%, i.e. at a pressure below 25 kPa. The vacuum is adjusted with respect to the boilin point of the drying medium, and should generally not exceed 98%.

At present, when drying impregnated wood, this is subjected to the influence of the drying medium during the required time and is, during this time, completely in contact with the drying medium or with the medium and foam produced from this. At the present process the material which is dried is, however, withdrawn from the direct contact with the drying medium at several times and the oil uptake is hereby regulated. At the first glance, this should not influence the oil retention as the heat transfer to the wood goes through the drying oil all the time. In practice it has, however, been found that repeated separations of the wood and the drying medium reduce the oil retention.

The separation of the wood and the drying medium according to the present invention is suitably accomplished by lifting the material up from the liquid medium and submerging it into it again. Other methods of accomplishing the separation are conceivable, the drying medium could e.g. be pumped out of and sucked into the autoclave. This is however impossible, as pumps which work against vacuum cannot have such a capacity that large amounts of oil can be pumped out against vacuum as quickly as required, i.e. within five to ten minutes.

By separating the material from contact with the drying medium according to the present invention, the drying is divided into periods and these are dependent on factors such as the penetration properties of the oil and the properties of the wood. The length of and the number of periods during which the materials are not in contact with the drying medium also vary wtih the applied vacuum. By using a higher vacuum during these periods the number of times that the material is lifted up from the drying medium can be made lower or alternatively the periods can be made shorter. The materials should suitably be withdrawn from contact with the drying medium for at least 5% of the total drying time, whereby optional final treatment at post-vacuum without contact with the drying medium is not included in the total drying time. The materials should preferably be withdrawn from the contact for at least 10 percent of the total drying time, and most preferably for at least 20 percent of the time. For some materials, depending on kind of wood and moisture content and other variables mentioned above, a very satisfactory effect can be obtained using only one separation. However, it is usually suitable to use at least three periods without direct contact, during the total drying time.

According to a preferred embodiment the intervals are intensified during the time when the treated material has a moisture content of between 30 and 50 percent. It is also possible to make all the withdrawals during this period.

The present process can be carried out without any essential lengthening of the usually used drying time. It has also been found that the process offers a possibility to shorten the total treatment time for obtaining a certain final moisture content in the treated material considerably, compared with conventional drying in oil. As usual the drying is stopped when about as much water or solvent as introduced with the preservative solution has been evaporated, and the materials are then generally subjected to a shorter period of post-vacuum without heating. When the material is lifted out of the drying medium this is satisfactory stirred and the recirculation of the drying medium which is generally required can be left out partly or completely at the present process. At drying in oil, the drying medium often foam very heavily for long periods. The present process makes it possible to adjust the amount of wood in contact with the drying medium and thereby to control the foaming to a certain extent. It is also possible to make all the active evaporation of solvent occur in those periods when the drying medium and the wood are separated and thereby avoid foaming almost completely.

Drying according to the present process is carried out in a container provided with suitable means for lifting the impregnated material and lowering this. In conventional impregnation-drying processes wherein the media are removed from the containers after completed treatment the same container, autoclave, is generally used both for the impregnation and the drying and this can of course also be the case in the present process. However, from several points of view it is advantageous to use a separate autoclave at the present process. In the impregnation-drying process the drying is the more time consuming operation and usually requires about five to ten times as long time as the impregnation. By using several separate drying autoclaves it is possible to increase the capacity considerably. Separate drying autoclaves can also be designed to give, in themselves, the highest possible capacity when it is not necessary to take the demands of the impregnation process into consideration. Using a separate drying container also reduces the risk of mixing of the impregnation solution and the drying oil. The dimensions of a drying autoclave for drying with separations of the material and the drying medium according to the invention shall be adjusted to give a sufficiently large free space above the surface of the liquid and a separate autoclave can in this case also be used as a storage container for the drying medium, without requirements on fixed partition walls. It is thus not necessary to use an external storage tank.

According to a preferred embodiment of the present process impregnated materials, and preferably materials impregnated with aqueous impregnating solutions, are treated in liquid, high-boiling drying media in an autoclave which is separate from the impregnation container, and which at the same time is a storage vessel for the drying medium.

One object of the present invention is to offer a drying container particularly suitable for the into periods divided drying process of the invention, which container is designed to give the greatest possible capacity and to avoid, pumping of the medium, clogging of conduits etc., to the largest possible extent.

The autoclave of the invention is in the known manner provided with inlet and outlet openings for the material, connections to conduits for liquid, conduits for evaporated condensed water or solvent from the impregnating solution etc. The autoclave can also contain an overflow for formed foam. The autoclave, the container, is further equipped with means which make it possible to lift the material out of the drying medium and submerging it therein. For this purpose cages, frames or tables which can be raised and lowered can be used. It is preferred to use frames or tables, which can be raised and lowered, as hereby materials of very varying dimensions can be treated in the same container and as the volume of the autoclave can be utilized to its full extent. With respect to the heat transfer it is preferred that the lifting and lowering device is a frame. If a table is used, it should preferably be perforated to avoid negative effects on the heat transfer. The lifting and lowering device is suitably provided with rails in order that the materials to be dried can be brought into the autoclave in trollies or the like.

Regarding the autoclave as such, an autoclave having a circular cross-section can be used, but it is preferred that the autoclave or the interior of the autoclave is rectangular as this means that the lifting and lowering device can be allowed to cover the main part of the cross section area and be allowed to pass through essentially the entire inner volume of the autoclave. The volume of drying medium can hereby be kept at a minimum. As has been mentioned, a drying autoclave for use at the present process can also serve as a storage tank for the drying medium as, in contrast to conventional processes, a final removal of the drying medium is not necessary.

As mentioned previously, the present process allows control of foaming at the drying. Problems with shock boiling can, however, not be avoided entirely and at these a vigorous foaming occurs and there are then risks that the foam will be sucked into the vacuum pumps. Instead of a continuous control of the foam level and dependency on taking steps to coaunteract when the foam exceeds a certain level it is preferred to provide the autoclave of the invention with an overflow, which is formed as a partition wall partitioning off a minor space in the far end of the container, counted from the inlet side. The overflow is preferably designed as a partition wall in the far end of the container which wall permits open communication with the major volume of the container, both at the top and at the bottom of the container. The wall can start a distance from the bottom of the container and end a distance from its top. Alternatively the wall can cover the entire cross section of the container and be provided with some kind of wall entrances, e.g. openings or perforations, both in its lower and upper part. As an overflow designed in this manner permits communication to the bottom of the container pumps or other devices, for re-introducing the from the foam obtained condensed oil phase to the main space of the drying container, are not required.

Different systems for lifting and lowering the selected support for the material to be treated are possible. To obtain the most smooth and easy lifting and lowering operation and to give the largest possible capacity it is preferred that an inner hydraulic cylinder system is used. Different arrangements of this are possible, a scissor system above the table or frame can for example be used. Again, in order to give the highest possible capacity, i.e. as big useable inner volume of the container as possible, it is preferred that synchronous hydraulic cylinders are arranged in the respective corners of the frame or table, which cylinders work from the upper part of the container.

The above described drying autoclave is intended especially for use at the present process. It gives a very large capacity, is easy to charge and clean, it works as a storage tank for the drying medium and further, pumps can be avoided to a large extent and clogging and control problems are reduced.

As regards the dimensions of the autoclave these should be adjusted, among other things with respect to the material to be treated and to give this a sufficient free space above the surface of the drying medium so that direct contact with this can be avoided. As has been mentioned the autoclave can also be used as a storage tank for the drying medium. As an example can be mentioned that for wood of standard dimensions a total inner height of the autoclave of 3 meters is suitable and of these the inlet opening for the wood can be 1.7 meters and the lower 1.3 meters is the storage container. When an overflow wall which does not go from top to bottom is used this can for example end about 10 to 50 centimeters from the top of the autoclave and about 5 to 40 centimeters from its bottom. The inner breadth of the autoclave can for example vary between 1 and 2 meters.

Figure 2:
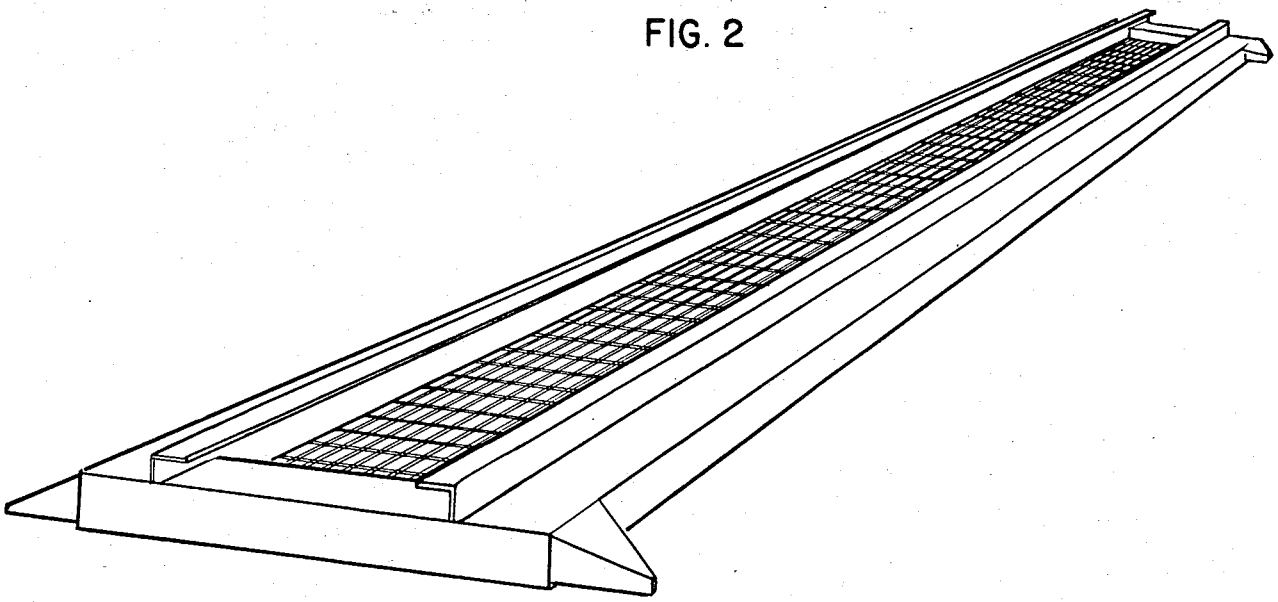
Figure 3:
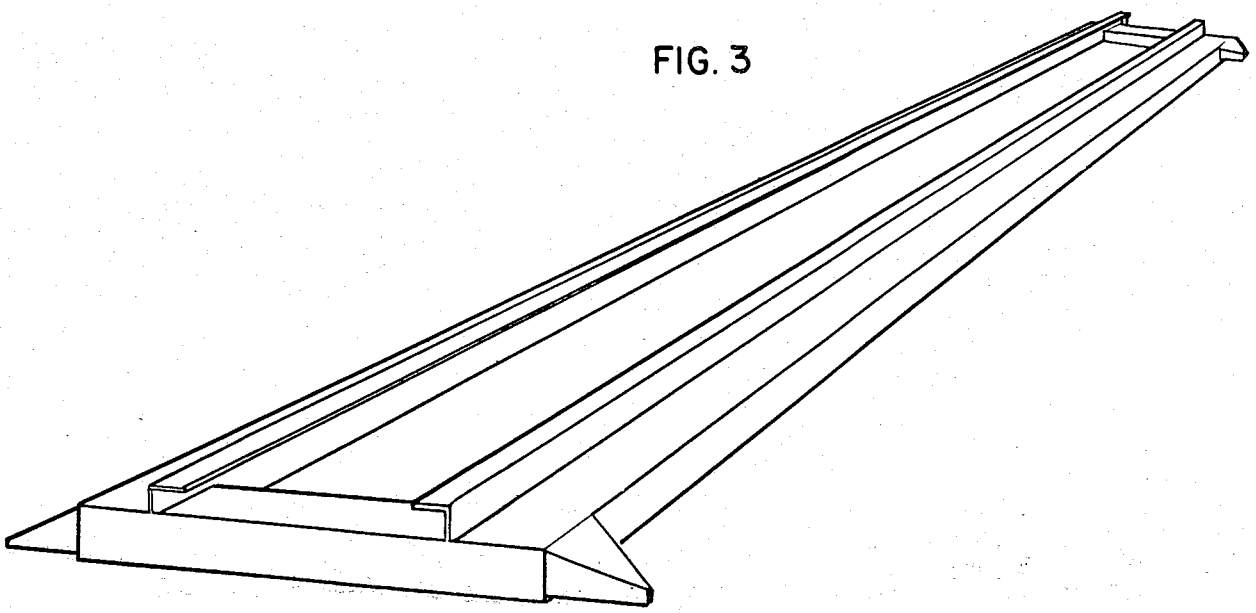

In the accompanying drawings FIG. 1 is a perspective drawing of a preferred embodiment of the drying autoclave and FIGS. 2 and 3 shows different designs of the lifting and lowering device.

In FIG. 1 is shown a drying autoclave having a rectangular cross section. The material is brought in through the inlet opening (1) on a trolley onto the frame (2) which is lifted and lowered by means of hydraulic cylinders (3). The far end of the container is partioned of by an overflow (4) which is formed as a wall permitting communication both at its upper and lower end. FIG. 2 shows a lifting and lowering device designed as a perforated table and FIG. 3 a device designed as a frame.

The invention is further illustrated in the following examples which, however, are not intended to limit the same.

EXAMPLES 1A AND 1B

In this example impregnated wood (*Pinus Silvestris*) was dried both according to the invention using a drying process divided into periods with intermediate separations of the wood from the drying medium (1a), and according to previous known process without separations (1b).

The tests were made on a laboratory scale using wood impregnated according to the full-cell method with a 2% CCA-solution. The impregnated wood had a moisture content of 120%.

Wood pieces having the dimensions 220.80.16 mm were introduced into a drying apparatus for laboratory tests in accordance with what has been described in the specification. The autoclave contained a drying medium comprising an oxidation-resistant oil combination.

(1a) The drying was here divided into seven different periods with intermediate separations of the wood from the drying medium and the wood was hereby lifted out of the drying medium. In the following is given time in minutes, temperature in °C. and vacuum in % for the respective drying period. For the respective period when the wood was separated from the drying medium is given the time in minutes and the vacuum in %.

Drying, period 1: 25, 40–80, 70
Separation 1: 20, 90
Drying, period 2: 30, 80–85, 90
Separation 2: 20, 90
Drying, period 3: 30, 80–85, 90
Separation 3: 45, 90
Drying, period 4: 30, 70–85, 90
Separation 4: 30, 90
Drying, period 5: 35, 70–80, 90
Separation 5: 30, 95
Drying, period 6: 30, 70–80, 90
Separation 6: 30, 95
Drying, period 7: 35, 80, 95

The treatment was finished by keeping the wood separated from the drying medium for 30 minutes under a vacuum of 95%. Including an initial heating time of about 30 minutes the total treatment lasted for 7.5 hours, and during this time the wood was in contact with the drying medium for 215 minutes.

When the treatment was completed the wood had a moisture content of 30% and an oil content of 10 kg/m$^3$.

(1b) In this test the wood was treated for a total period of 7.5 hours. The initial heating took about 30 minutes and the wood was then kept in the drying medium for 6.5 hours at 80°–85° C. and at a vacuum of 80–85%. The treatment was completed by separating the wood from the drying medium and keeping it for 30 minutes under a vacuum of 95%.

When the treatment was completed the wood had a moisture content of 40% and an oil content of 80 kg/m$^3$.

EXAMPLE 2

In this test impregnated the wood was dried according to the invention and the drying was divided into five periods. The wood had been impregnated with a 2% CCA-solution and had a moisture content of 163%. The treatment was carried out in the manner described in example (1a).

For the respective drying period is given the time in minutes, the temperature in °C. and the vacuum in %. For the respective periods when the wood was separated from the drying medium is given the time in minutes and the vacuum in %.

Drying, period 1: 35, 40–80, 70
Separation 1: 20, 90
Drying, period 2: 50, 70–80, 80
Separation 2: 20, 90
Drying, period 3: 65, 70–85, 85
Separation 3: 20, 90
Drying, period 4: 60, 85, 85
Separation 4, 30, 95
Drying, period 5: 60, 85, 95

The treatment was finished with separation of the wood from the drying medium and keeping this at a vacuum of 95% for 30 minutes. Including an initial heating time of 30 minutes the total treatment took 7.0 hours and the wood was in contact with the drying medium for 4.5 hours of this time.

The treated wood had a moisture content of 40% and a oil content of 36 kg/m$^3$.

I claim:

1. In the process of removing water or solvent from impregnated materials selected from the group of wood and other cellulose-based products by treating the impregnated materials with a high-boiling oil drying medium under reduced pressure conditions, the improvement which comprises accelerating said removal and reducing oil retention in said impregnated materials, by the sequential steps of:

(a) establishing a drying zone that includes a reservoir of a high-boiling oil drying medium and liquid-free zone of reduced pressure below 25 kPa thereabove, said high-boiling oil selected from the group consisting of linseed oil, tall oil, soybean oil, colza oil and mineral oils, and having a boiling point above 250° C., and said reservoir being maintained at a temperature of 60°–110° C., (b) introducing said impregnated material into said drying zone and immersing said impregnated material in said reservoir of high-boiling oil, (c) thereafter removing said impregnated material from contact with said reservoir of high-boiling oil and maintaining it in said liquid-free zone of reduced pressure for a period of time, (d) repeating steps (b) and (c) in sequence at least three times, said impregnated material being withdrawn from said high-boiling oil drying medium at least 20% of the total time that it is in said drying zone, and (e) ceasing the process when about as much water or solvent as introduced with the impregnated materials has been evaporated.

2. A process according to claim 1 wherein the boiling point of said high-boiling oil is above 300° C.

3. A process according to claim 1 or claim 2 wherein the temperature of said reservoir in step (a) is between 60° and 90° C.

4. A process according to claim 1 wherein removals of the impregnated material from contact with said reservoir in accordance with step (c) occur when the moisture content of said impregnated material is within the range of 30–50%.

5. In the process of drying impregnated materials selected from the group of wood and other cellulose-based products by treating the impregnated materials with a high-boiling oil drying medium under reduced pressure conditions, the improvement which comprises accelerating the drying and reducing oil retention in said impregnated material, by the sequential steps of:

(a) establishing a drying zone that includes a reservoir of a high-boiling oil drying medium and liquid-free zone of reduced pressure thereabove, said high-boiling oil having a boiling point above 250° C. and said reservoir being maintained at a temperature of 60°–110° C., (b) introducing said impregnated material into said drying zone and immersing said impregnated material in said reservoir of high-boiling oil, (c) thereafter removing said impregnated material from contact with said reservoir of high-boiling oil and maintaining it in said liquid-free zone of reduced pressure for a period of time, and (d) repeating steps (b) and (c) in sequence at least several times, said impregnated material being withdrawn from said high-boiling oil drying medium at least 5% of the total time that it is in said drying zone.

6. A process according to claim 5 wherein the drying process is stopped when about as much mater or solvent as introduced with the impregnated materials has been evaporated.

7. A process according to claim 5 wherein the boiling point of said high-boiling oil is above 300° C.

8. A process according to claim 5 or 6 or 7 wherein the temperature of said reservoir in step (a) is between 60° and 90° C.

9. A process according to claim 5 wherein said drying medium is at least one material selected from the group consisting of linseed oil, tall oil, soybean oil, colza oil and mineral oils.

10. A process according to claim 5 wherein removal of the impregnated material from contact with said reservoir in accordance with step (c) occur when the moisture content of said impregnated material is within the range of 30–50%.

* * * * *

REEXAMINATION CERTIFICATE (485th)

United States Patent [19]

Estberg

[11] B1 4,407,076

[45] Certificate Issued Apr. 8, 1986

[54] PROCESS FOR TREATING WOOD

[75] Inventor: Magnus F. O. Estberg, Rimbo, Sweden

[73] Assignee: Kenogard AB, Stockholm, Sweden

Reexamination Request:
No. 90/000,728, Feb. 22, 1985

Reexamination Certificate for:

| | |
|---|---|
| Patent No.: | **4,407,076** |
| Issued: | **Oct. 4, 1983** |
| Appl. No.: | **311,409** |
| Filed: | **Oct. 14, 1981** |

[30] Foreign Application Priority Data

Oct. 17, 1980 [SE] Sweden ..... 8007297

[51] Int. Cl.[4] ..... F26B 3/00; F26B 5/04

[52] U.S. Cl. ..... 34/9.5; 34/13.8; 34/16.5

[58] Field of Search ..... 34/9.5, 13.8, 16.5, 34/13.4

[56] References Cited

FOREIGN PATENT DOCUMENTS 136057 4/1977 Norway .

*Primary Examiner*—L. I. Schwartz

[57] ABSTRACT

Impregnated wood and other impregnated cellulose based materials are dried in high boiling drying media, drying oil, under reduced pressure. During the treatment the material is withdrawn from direct contact with the drying medium at several times. The absorption of oil in the materials can hereby be controlled. Materials of different qualities and origin can be dried with good results and the oil absorption does not have to be made dependent on the penetration depth of the impregnating solution. An autoclave for drying of wood according to this process preferably has a rectangular inner cross section and is provided with means for lifting and lowering the materials. Preferably a lifting table or frame.

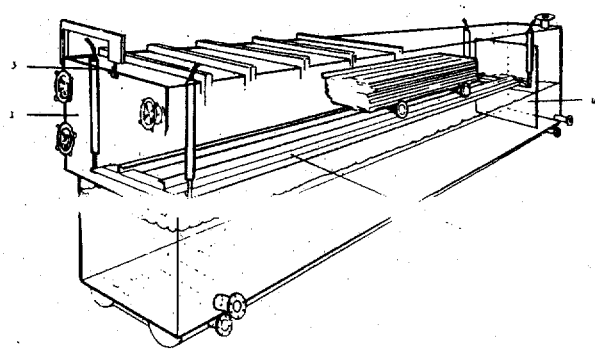

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–10 are cancelled.

* * * * *